United States Patent [19]

Palmaer

[11] 4,186,523

[45] Feb. 5, 1980

[54] SKYLIGHT OPERATING MEANS

[76] Inventor: Tore G. Palmaer, S-330 30 Gnosjo, Sweden

[21] Appl. No.: 916,549

[22] Filed: Jun. 19, 1978

[30] Foreign Application Priority Data

Jan. 9, 1977 [SE] Sweden ..... 7709837

[51] Int. Cl.[2] ..... E05D 15/10

[52] U.S. Cl. ..... 49/209; 49/361; 74/89.12; 52/72; 49/214

[58] Field of Search ..... 49/208, 209, 210, 213, 49/214, 221, 224, 358, 362, 361; 52/72; 74/89.12, 52, 29, 89.11, 393

[56] References Cited

U.S. PATENT DOCUMENTS

| | | | |
|---|---|---|---|
| 594,553 | 11/1897 | Pearson | 49/361 |
| 2,336,530 | 12/1943 | Chandler et al. | 49/361 X |
| 3,708,914 | 1/1973 | Ansund | 49/209 |
| 3,934,635 | 1/1976 | Kin | 49/358 |

*Primary Examiner*—Kenneth Downey

[57] ABSTRACT

A drive system for a movable closure member movable along rail sets carried on opposed sides of the frame of a structure includes a rail set on each side of at least one pair of opposed sides of the frame. Each rail set includes first and second laterally offset toothed sections. Each first section includes a horizontal segment and an inclined segment whereas each second segment includes a vertical segment and an inclined segment which has at least a portion thereof in juxtaposed side-by-side relation with the inclined segment of the first section. An electric motor has a drive shaft that extends transversely of the rail sets and carries a first gear wheel coaxially therewith at each end. Each first gear wheel carries a second and smaller gear wheel eccentrically thereon. The first and second gear wheels have a common point of tangency. The first gear wheels are cooperable with the first sections of the respective rail sets and the second gear wheels are cooperable with the second sections of the respective rail sets. The respective rail sections and gear wheels are dimensioned to provide for transfer of driving force between the first and second gear wheels when the common point of tangency therebetween falls within the juxtaposed side-by-side portions of the respective inclined segments of the rail sets.

5 Claims, 3 Drawing Figures

SKYLIGHT OPERATING MEANS

BACKGROUND OF THE INVENTION

The present invention relates to a means for operating tightly fitting windows, doors, hatches and the like, (such as skylights, sliding doors and hatches for watertight bulkheads) with the help of an electric motor fitting adjacent the skylight, or the like, effecting movement on outer parallel rails and inner parallel rails attached on the window frame, or the like.

When opening and closing skylights, for instance, considerably more force is required in the initial stage than in the continued opening or closing process. Mechanism for operating skylights and the like are therefore normally designed for the first amount of force necessary which means that motors and gears, for instance, are designed to be relatively powerful and are therefore expensive.

OBJECT OF THE INVENTION

It is an object of this invention to provide improved operating means.

SUMMARY OF THE INVENTION

According to this invention, there is provided means for operating items such as tightly fitting windows, doors, hatches and the like, such as skylights, sliding doors and hatches for watertight bulkheads, with the help of an electric motor fitted by the said item, effecting movement on outer parallel rails and inner parallel rails attached on a frame, for the item, the drive shaft of the motor, which extends horizontally between the inner rails being provided at each end with a first centrally journalled toothed wheel, and a second, smaller, eccentrically journalled toothed wheel which touches the first toothed wheel internally at a tangent point, each inner rail being in the form of at least two laterally displaced toothed rods, each co-operating with a toothed wheel, said toothed rods forming a horizontal section, a vertical section and therebetween a downwardly sloping or curved section from the horizontal section, the toothed wheels and toothed rods being arranged to co-operate with each other to obtain initially a vertical movement or lifting of the said item when the motor is engaged, and thereafter an increasing lateral movement of the item, a tangent point for two adjacent toothed wheels being arranged to coincide with an existing transition point between two adjacent, laterally displaced toothed rods.

BRIEF DESCRIPTION OF THE DRAWINGS

In order that the invention may be more readily understood, and so that further features thereof may be appreciated, the invention will be described by way of example with reference to the accompanying drawings, in which.

DESCRIPTION OF PREFERRED EMBODIMENTS

Figure 1:
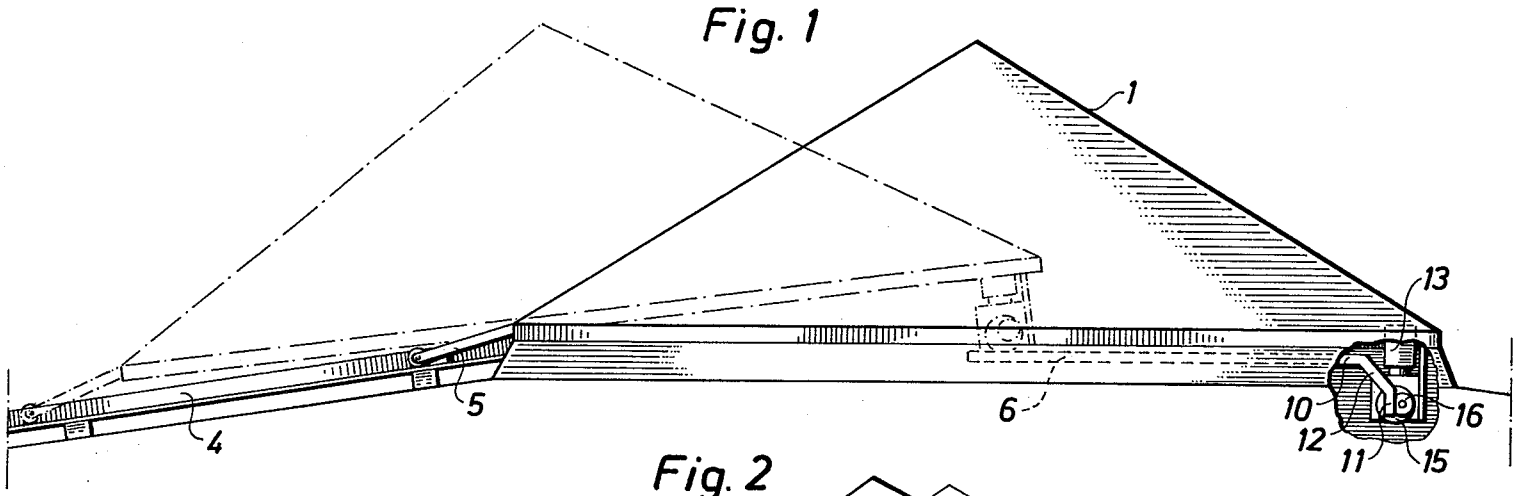
FIGS. 1 and 2 show one side of a skylight in different positions, with an operating means according to the present invention.

It will of course be recognized that although only one side of the skylight and the adjacent roof construction has been illustrated, except for motor 13 the construction on the other side of the skylight is identical to that shown.

In the drawings a dome-shaped skylight is designated 1, the frame 2 of the skylight sealing against the adjacent roof construction by means of sealing strips 3. Two parallel outer rails 4 are arranged on opposed sides of the roof close to the skylight which is thus supported by two support arms 5 provided with wheels when in the open position. The support arms are attached to the skylight and extend out from one edge. Inside the opposite edge of the skylight is an operating means in accordance with the present invention co-operating with two parallel inner rails 6 arranged on support strips 7 attached to opposed sides of the roof. The inner rails consist of two laterally displaced or offset toothed rods 8, 9 (front and rear, respectively), forming a horizontal section 10, a vertical section 11 and therebetween an oblique or sloping section 12.

Figure 3:
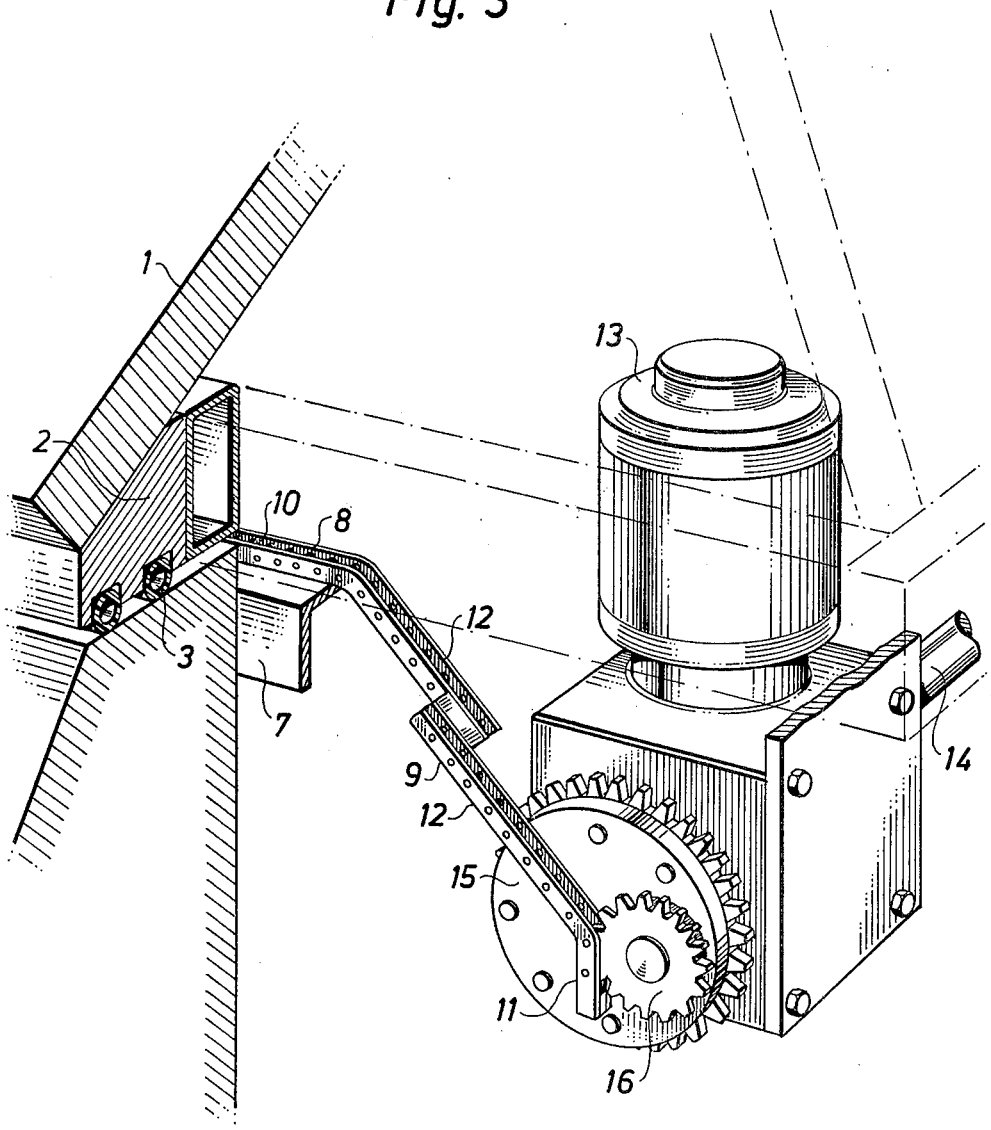
FIG. 3 shows essential parts of the operating means according to FIGS. 1 and 2 on one side of the skylight.

Said window-operating means comprises an electric motor 13 which, by means of a worm gear, drives a horizontal shaft 14 arranged perpendicular to the rails 4, 6. At each end of the drive shaft 14 is a centrally journalled toothed wheel 15 which is arranged to co-operate with the front toothed rod 8, a smaller toothed wheel 16 being eccentrically journalled on the toothed wheel 15 to co-operate with the rear, vertical toothed rod 9. As mentioned, and as can be seen in FIG. 3, these front and rear toothed rods are displaced laterally in relation to each other and they have about two teeth substantially coinciding at the transition point within the sloping toothed section 12.

Figure 2:
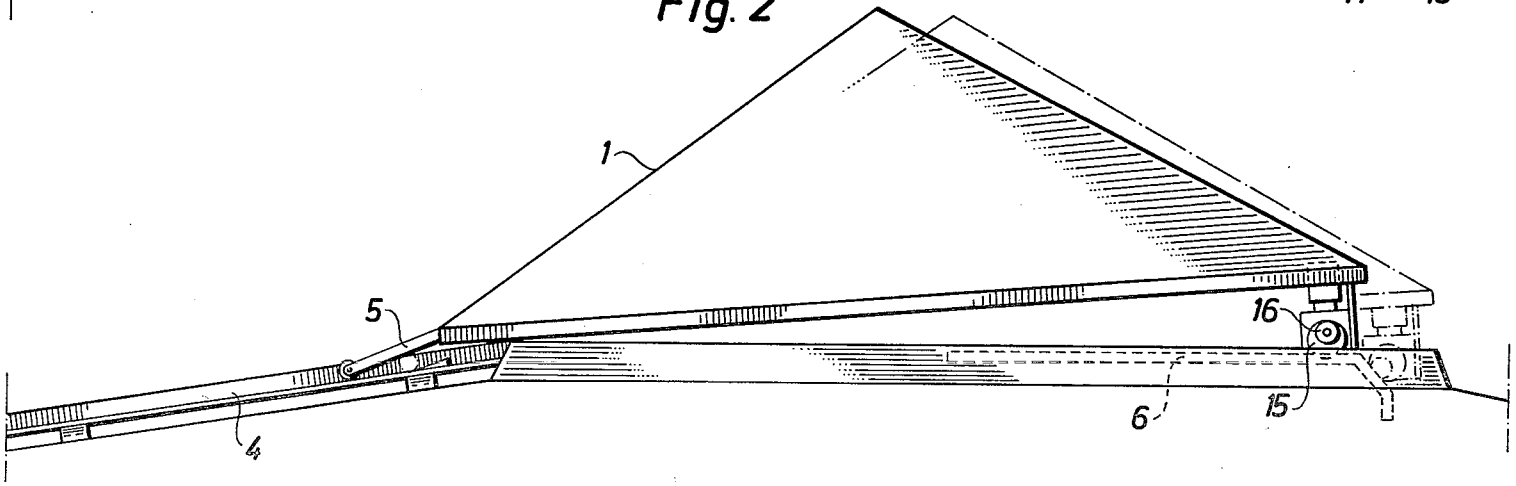

When the motor is engaged, the eccentric, smaller toothed wheel lifts the window with considerable force and low speed, after which the window is moved laterally as soon as the smaller toothed wheel comes into engagement with the inclined toothed section 12 of the rear toothed rod 9. Specific for the toothed wheel arrangement is that the periphery of the smaller toothed wheel 16 and that of the larger toothed wheel 15 touch each other internally at one point and that toothed rods and toothed wheels are located and dimensioned in relation to each other so that the transition from one toothed rod to the other toothed rod occurs when the tangent point of the toothed wheels is passed, as illustrated in FIG. 2 in broken lines. The invention thus provides an automatically variable gear between motor and feeding mechanism. Since the other end of the window is supported by arms provided with wheels (the arms extending outside the skylight) the window is lifted from its sealing position when the motor unit opens the window in the initial stage. Removal of the skylight is prevented by the rails being in the form of a U or by link rollers running behind a single beam. The rails should be in line with the surrounding roof and so on to avoid unnecessary vertical or lateral movement caused by difference between the skylight and these surfaces.

A number of important advantages are gained by means of the operating mechanism described above. It provides good sealing thanks to the extremely strong tension obtained by the exertion of the motor force on the little toothed wheel and by the arm between the link wheels of the support arms 5 and the skylight. All main parts are indoors and communication between the metallic parts and the outer rails is not necessary and the thermal insulation can therefore be unbroken. Ventilation can be obtained through the skylight without removing the window (in rainy weather, etc.). The means is ideal for mass production since it can be adjusted merely by the length of the rails to windows of various dimensions, as opposed to previously known constructions which are normally designed to fit a specific window. The operating means is easy to produce, not only with automatic end position stop, but also with optionally adjustable automatic stop. During autumn and winter, for instance, the skylight is only used for airing purposes and a part-way stop only lifting the window may be used by pushing a button marked "airing", whereas during the summer the window is usually removed to permit sun-bathing indoors, in which case an operating button marked "sun-bathing" may be pushed.

The invention is particularly preferred for use with skylights but it should be understood that it can be used in other applications to operate tightly fitting doors, hatches and the like, such as sliding doors and hatches for water-tight bulkheads.

The support beams 7, one of which is shown in FIG. 3, also extend down (not shown) below the toothed rods to provide reliable support therefor.

I claim:

1. A drive system for a movable closure member movable along rail sets carried on opposed sides of the frame of a structure, said drive system, comprising a rail set on each side of at least one pair of opposed sides of the said frame, each said rail set including first and second laterally offset toothed sections, each said first section having a horizontally extending segment and a downwardly extending segment, each said second section having a vertically extending segment and an upwardly extending segment, a portion of said downwardly and upwardly extending segments being juxtaposed in side-by-side relation; an electric motor carried by said closure member for movement therewith and having a drive shaft extending transversely of said rail sets; a first gear wheel mounted at each end of said drive shaft coaxial therewith and cooperable with the respective first sections of said rail sets; a second and smaller gear wheel mounted eccentrically on each said first gear within the periphery thereof and cooperable with the respective second sections of said rail sets, each said second gear being arranged on its associated first gear such that they have a substantially common point of tangency; and the respective rail sets and first and second gear wheels being dimensioned relative to each other such that during activation of the electric motor and closure member is initially raised vertically during engagement of the second gears with the vertical segments of said rail sets, is advanced partially vertically and partially longitudinally during engagement of said second and first gears respectively with the upwardly extending and downwardly extending segments of said rail sets, and is advanced longitudinally during engagement of said first gears with the horizontal segments of said rail sets; said dimensioning being selected to insure that transfer of the driving force of said first and second gear wheels from one to the other takes place when the point of common tangency of said gears falls within the portions of said upwardly and downwardly extending segments juxtaposed in side-by-side relation.

2. A drive system according to claim 1, wherein said rail sets are carried by said frame to extend therealong and be coextensive with one end portion of said closure member when the closure member is in a closed position on the frame.

3. A drive system according to claim 2, including support arms extending from the other end of said closure member and rail elements on the frame of the structure longitudinally removed from said rail sets and in general longitudinal alignment therewith, said support arms being provided with roller means rollable on said rail elements for support of said other end of the closure member.

4. A drive system according to claim 1, wherein said rail sets are carried by the frame of the structure interiorly of the closure member to be sheltered thereby when the closure member is in its closed position.

5. A drive system according to claim 1, wherein said first and second sections of each of said rail sets are offset laterally by a distance substantially equal to the thickness of said second gear wheels.

* * * * *